US006357605B1

(12) United States Patent
Martorella

(10) Patent No.: US 6,357,605 B1
(45) Date of Patent: Mar. 19, 2002

(54) DEVICE FOR DRYING OBJECTS

(76) Inventor: Rudolph Martorella, 2 Spruce St., Apt. 4A, Great Neck, NY (US) 11021

( * ) Notice: Subject to any disclaimer, the term of this patent is extended or adjusted under 35 U.S.C. 154(b) by 0 days.

(21) Appl. No.: 09/568,915

(22) Filed: May 11, 2000

(51) Int. Cl.[7] ..... A47G 19/08
(52) U.S. Cl. ..... 211/41.6; 211/41.5
(58) Field of Search ..... 211/41.6, 41.2, 211/41.3, 41.4, 41.5, 2, 133.5, 132.1, 70.7, 85.25, 90.03, 106, 119.003, 181.1; D32/55–57; 248/448, 449, 454–457, 463–465, 465.1

(56) References Cited

U.S. PATENT DOCUMENTS

| | | | | | |
|---|---|---|---|---|---|
| 378,692 | A | * | 2/1888 | Latham | 211/41.5 |
| 815,480 | A | * | 3/1906 | Silven | 211/41.5 |
| 990,454 | A | * | 4/1911 | Peters | 211/41.5 |
| 1,564,594 | A | * | 12/1925 | Leh | |
| 1,712,342 | A | * | 5/1929 | Fitzgerald | 211/41.6 |
| 1,714,629 | A | * | 5/1929 | Rodin | 211/41.6 |
| 1,822,087 | A | * | 9/1931 | Feingold | 211/41.5 |
| 2,443,404 | A | | 6/1948 | Tallarico | |
| 2,479,118 | A | | 8/1949 | Jenness | |
| 2,516,088 | A | | 7/1950 | Einhorn | |
| 2,708,037 | A | * | 5/1955 | Planeta | 211/41.5 |
| 2,841,288 | A | * | 7/1958 | Field et al. | 211/41.5 |
| 2,936,898 | A | * | 5/1960 | Miguez | 211/41.3 |
| 2,958,424 | A | * | 11/1960 | Bigatti | 211/41.5 |
| 3,025,967 | A | * | 3/1962 | Christophersen | 211/41.5 |
| 3,027,041 | A | * | 5/1962 | Stansbury, Jr. et al. | 211/41.3 |
| 3,464,566 | A | * | 9/1969 | Gilson | 211/41.9 |
| 4,169,638 | A | * | 10/1979 | Cirasuolo et al. | 211/41.6 |
| 4,726,475 | A | * | 2/1988 | Ferenzi | 211/41.5 |
| 4,756,582 | A | | 7/1988 | Heien | |
| 4,969,560 | A | * | 11/1990 | Stanfield | 211/41.5 |
| 5,119,943 | A | * | 6/1992 | Hoang | 211/41.3 |
| 5,332,105 | A | * | 7/1994 | Stanfield | 211/41.3 |
| 5,480,035 | A | * | 1/1996 | Smith | 211/41.5 |
| 5,485,927 | A | | 1/1996 | Hubbard | |
| 5,503,279 | A | * | 4/1996 | Wentworth | 211/181.1 |
| 5,651,525 | A | * | 7/1997 | Yang | |
| 6,170,676 | B1 | * | 1/2001 | Patadia et al. | 211/41.6 |
| 6,179,134 | B1 | * | 1/2001 | Pine et al. | 211/41.3 |

* cited by examiner

*Primary Examiner*—Daniel P. Stodola
*Assistant Examiner*—Jennifer E. Novosad

(57) ABSTRACT

A device for supporting objects for drying containing a catch basin, for receiving fluid that drips off of these drying objects. Attached to the catch basin is a first adjustable rack, having a front end and a back end. The back end of the first adjustable rack is rotatably supported within the catch basin. In addition, attached to the back end of the first adjustable rack is a second adjustable rack. This second adjustable rack is rotatably attached to the first adjustable rack and extends in a substantially upright or vertical position. The second adjustable rack is rotatably attached to the first adjustable rack and is for supporting the objects for drying. Both the first adjustable rack and the second adjustable rack are comprised of a series of parallel extending bars that are spaced apart from each other to receive a plate between these parallel extending bars. These parallel extending bars are also designed to support a series of pots on either the first adjustable rack or the second adjustable rack wherein these parallel extending bars allow water to drip down through the bars and into the catch basin. In addition there is also an adjustable tray disposed adjacent to the adjustable racks wherein the adjustable tray is designed to support kitchen utensils and silverware in an upright manner for drying. The device can also be collapsed to allow this device to be folded up to stand freely upright on a substantially horizontal surface.

14 Claims, 7 Drawing Sheets

DEVICE FOR DRYING OBJECTS

BACKGROUND OF THE INVENTION

1. Field of the Invention

The invention relates to a device for supporting objects for drying. More particularly, this invention relates to an adjustable device that is designed to allow plates, pots, kitchen utensils and silverware to dry.

2. Summary of the Invention

The invention relates to a device for supporting objects for drying. This device contains a catch basin, for receiving water that drips off of these drying objects. Attached to the catch basin is a first adjustable rack that is positioned in a substantially horizontal manner. This first adjustable rack has a front end and a back end wherein the back end is rotatably supported within the catch basin. In addition, there is also a second adjustable rack that is rotatably attached to the catch basin and extends in a substantially upright or vertical position. Both the first adjustable rack and the second adjustable rack are comprised of a series of parallel extending bars that are spaced apart from each other to receive a plate between these parallel extending bars or to allow pots to rest thereon. The bars are spaced far enough apart so that they allow water to drip down through the bars and into the catch basin.

In addition, there is an adjustable support bar that is rotatably attached to the substantially horizontal adjustable rack. This adjustable support bar is for rotatably adjusting the height of the front end of the substantially horizontal adjustable rack. Furthermore, disposed within the catch basin is a series of support strips wherein the support strips are designed to support the adjustable support bar in a particular position to keep the adjustable support bar from rotating when the support bar is supporting the substantially horizontal adjustable rack. The support bar is also useful in that when it is positioned flat, it extends out from the substantially horizontal rack to support extra large pots or pans.

This device is also designed to prevent any water or other materials from flowing onto a counter top outside of the catch basin. For example, the catch basin contains a series of substantially vertical walls to trap this water within the catch basin. In this way, the water will not flow outside of the catch basin and onto a counter top. However, there are at least two drainage holes disposed within the substantially vertical walls to allow a user to easily pour the water disposed within the catch basin out into a sink.

The device also contains an adjustable tray attached to the catch basin for supporting a series of utensils. The adjustable tray also comprises a set of adjustable legs rotatably attached to the catch basin, a top plate attached to the adjustable legs wherein this top plate has holes for supporting the silverware and utensils in an upright manner. The top plate is adjustable from a folded up position to a folded down position so that the tray can be stored easily. In addition disposed within the catch basin are a series of circular support bins for receiving a bottom portion of utensils and silverware so that this silverware can be supported in an upright manner. If these circular support bins were not present within the catch basin, the silverware might slide out from underneath the top tray.

The adjustable tray also further comprises a support arm having a first end rotatably attached to the catch basin and a second end designed to lock the adjustable tray in an upright position. Thus, when the tray is in its upright position, the support arm is extended up to secure the adjustable tray in a fixed position. This tray is primarily designed to receive kitchen utensils and silverware and is designed to allow these utensils and silverware to dry while in an upright position.

One of the benefits of this invention is that it can be folded down into a storage position wherein the rack can then be stored away. To facilitate this feature, there is also a catch block disposed within the catch basin wherein this catch block is designed to receive a top end spacer bar on the second adjustable rack to lock the top end spacer bar in place on the catch block. The catch block also contains a slot that is angled in so that it restricts the movement of the spacer bar in the second adjustable rack once the second adjustable rack is snapped in.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
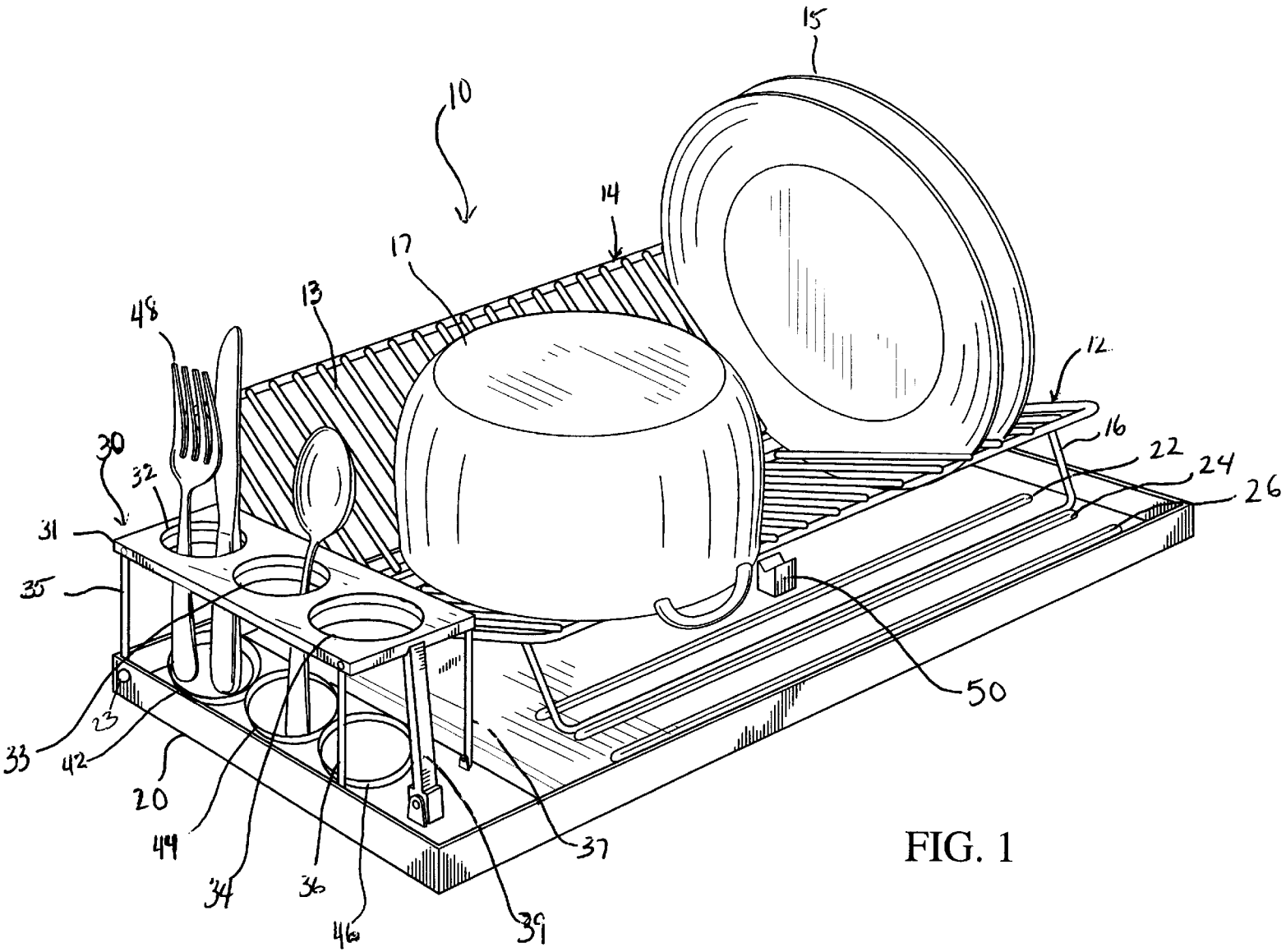
FIG. 1 represents a perspective view of the invention in its upright position supporting plates, a pot, and silverware for drying.

FIG. 1 refers to a perspective view of the invention wherein there is shown a device 10 for drying plates, pots and silverware. Here, there is a first rack 12 rotatably attached to a catch basin 20, and a second rack 14 rotatably attached to catch basin 20. Both first rack 12 and second rack 14 contain a series of parallel extending bars 13 that are spaced apart by first and second spacer bars 12', 12", 14', and 14" on first and second racks 12 and 14 respectively. These parallel extending bars 13 are spaced apart to receive a series of plates 15 or at least one pot 17. These parallel extending bars 13 are spaced apart to allow water to drip off of pots and into catch basin 20. Water can then be drained from catch basin 20 via a drainage hole 23 positioned on a side wall of catch basin 20.

Figure 2:
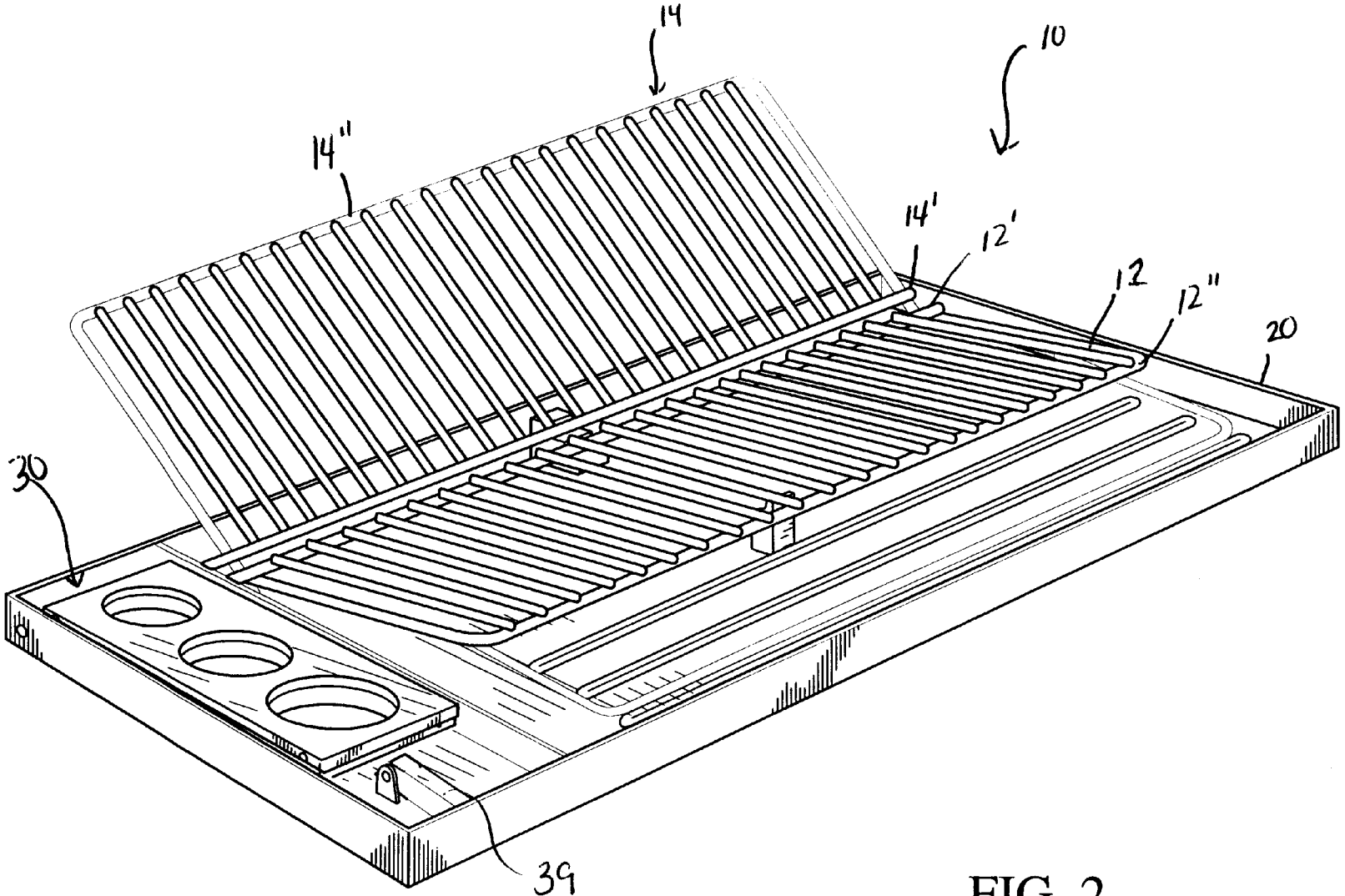
FIG. 2 represents a perspective view of the invention wherein the first adjustable rack is extended in a downward position.

As shown in FIG. 2, the first rack 12 contains a first end bounded by spacer bar 12' that is rotatably mounted within catch basin 20 and a second end bounded by spacer bar 12" that extends across catch basin 20. Attached to the second end of first rack 12 is a support bar 16 for supporting the second end of the first rack 12 at different elevations.

The elevation of the second end of the first rack can be set by setting support bar 16 within one of three different support strips 22, 24, and 26 designed to receive support bar 16. These support strips extend parallel across the catch basin 20 so that the support bar 16 can rest against each support strip to position the second end of the first rack 12 at varying heights. The support bar 16 is pushed against each support strip by a gravitational force exerted by first rack 12. In addition, if there are any plates 15, or pots 17 placed on first rack 12, this also exerts an additional gravitational force on support bar 16 to further set support bar 16 against one of the support strips 22, 24, or 26.

By elevating the second end of first rack 12 this narrows the distance between the first rack 12 and the second rack 14 so that different sized plates or pots can fit snugly between parallel extending bars 13 on both first rack 12 and second rack 14.

In addition, disposed adjacent to first rack 12 and second rack 14, is a tray 30 designed to support kitchen utensils and silverware 48 in an upright position. In this case, the tray consists of a plate 31 that has a series of holes 32, 33, and 34 that are designed to receive these kitchen utensils (not shown) and silverware 48 within, while supporting these objects in an upright manner.

The plate 31 is supported by a series of supporting arms 35, 36, 37, and a fourth arm (not shown) while this plate 31 is held in place by a support arm 39 designed to fix plate 31 in place. In this way, plate 31 provides a static support for kitchen utensils or silverware as it is drying.

Disposed below the plate 31 is a series of circular containers or storage bins 42, 44, and 46 serving as lateral supports for the silverware 48 or utensils, not shown. These containers are designed to receive the utensils 48 to support these utensils in a substantially vertical manner within plate 31.

Figure 3:
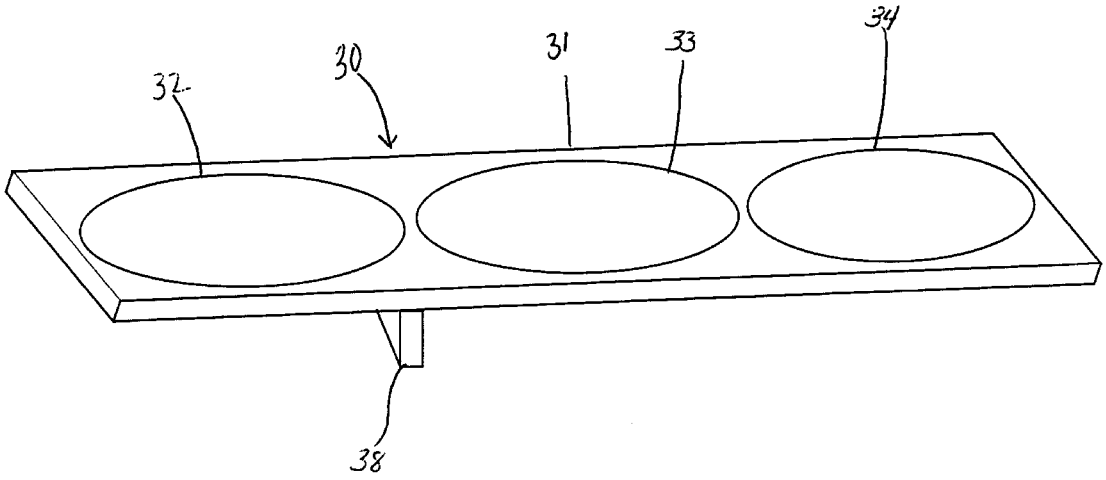
FIG. 3 shows a side view of a tray for supporting silverware.
Figure 4:
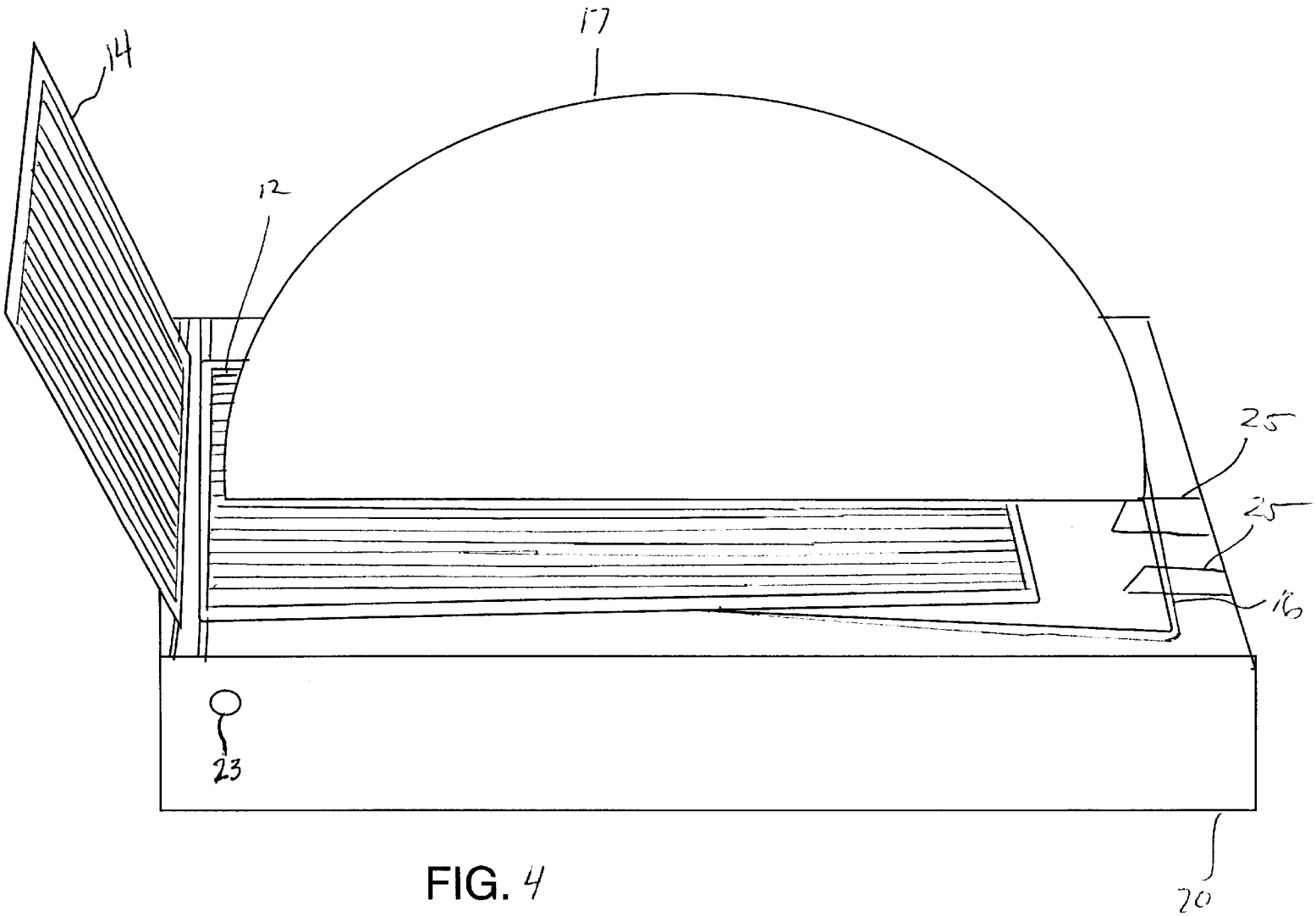
FIG. 4 shows a perspective view of the invention wherein the first adjustable rack is extending in a downward position and the support bar extends out to support a large bowl.
Figure 5:
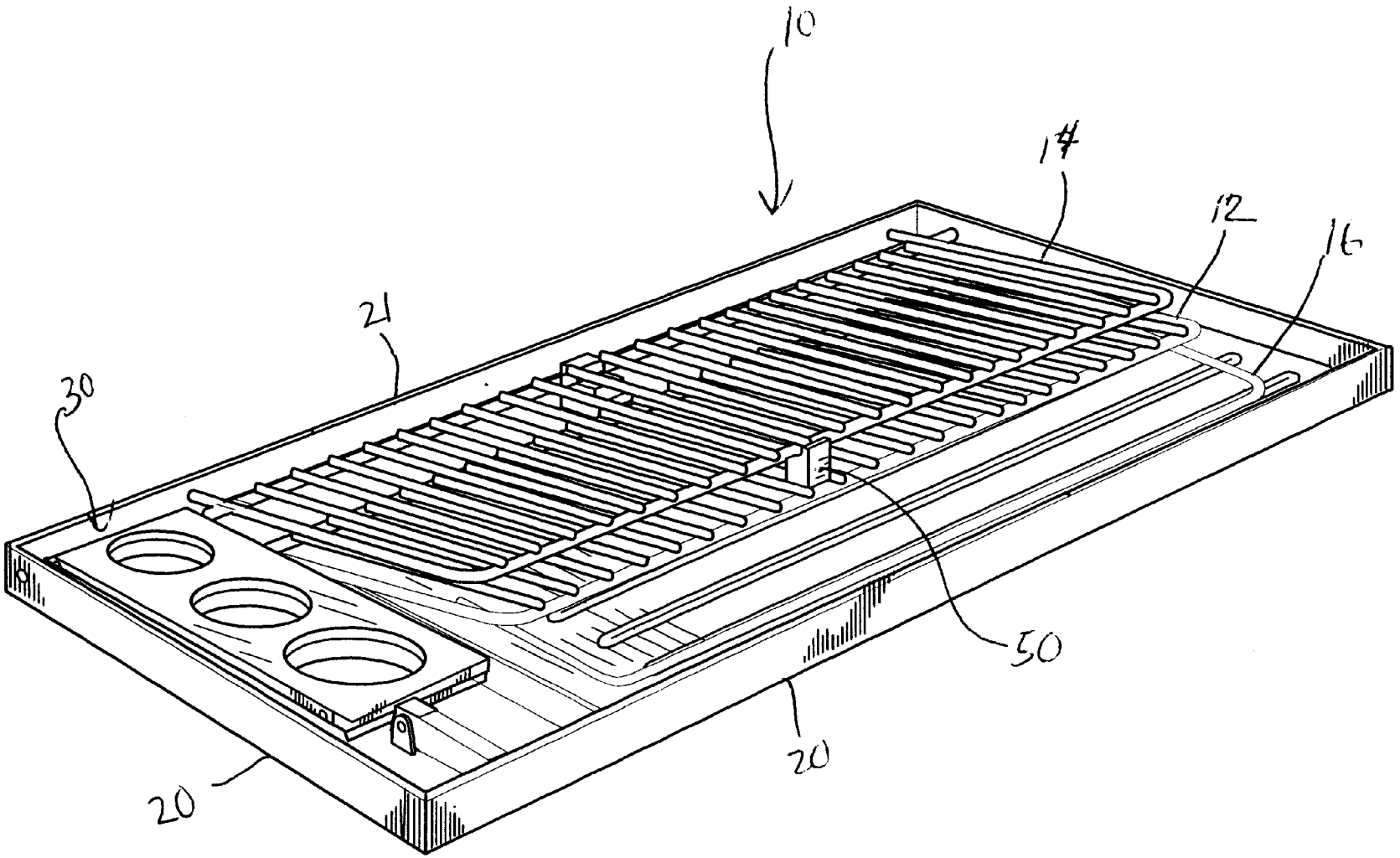
FIG. 5 is a perspective view of the dish rack in the folded down position.

Both the tray 30, the first rack 12, the second rack 14 and the support bar 16 can be folded down so that the device 10 can be collapsed into a substantially flat position using a tab 38 as shown in FIG. 3. Tab 38 is disposed between holes 32 and 33 and extends down from plate 31 so that a user can simply reach his or her fingers into holes 32 and 33 and grip tab 38 to either raise or lower plate 31. Plate 31 can be positioned in a lowered position as shown in FIGS. 2 and 5. When device 10 is in its substantially flat position, catch basin 20 can be folded up to be free standing upright on wall 21 of catch basin 20. In this way, once device 10 has been fully collapsed, device 10 only takes up a minimal amount of counter space. In addition, as shown in FIG. 4, when rack 12 is folded down into a substantially flat position, support arm 16 extends out so that it is supported on support ridges 25 that lend support to support arm 16. In this way support arm 16 forms a substantially horizontal support that extends out beyond first rack 12 to support especially large pots.

Figure 6:
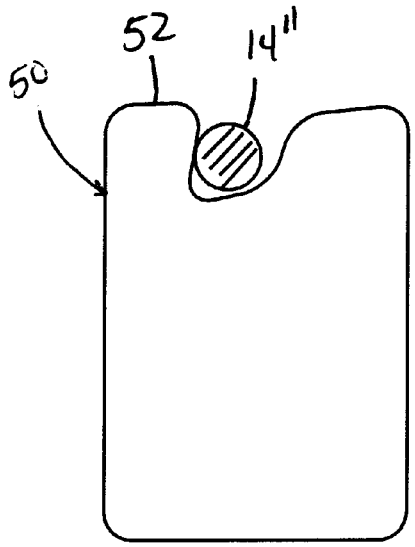
FIG. 6 is a side view of a catch block for catching the front end of the second adjustable rack.

As shown in FIG. 5, there is also at least one catch block 50 that is disposed within catch basin 20, wherein as shown in FIG. 6, this catch block 50 is designed to receive the spacer bar 14" resting within catch block 50. Catch block 50 contains an elevated first end 52 that is designed to receive spacer bar 14" of the second rack 14. This spacer bar 14" of second rack 14 fits snugly inside catch block 50 so that the device can be folded down in a compact position as shown in FIG. 5 and then tilted up on back wall 21 of catch basin 20 for storage as shown in FIGS. 8 and 9.

Figure 7:
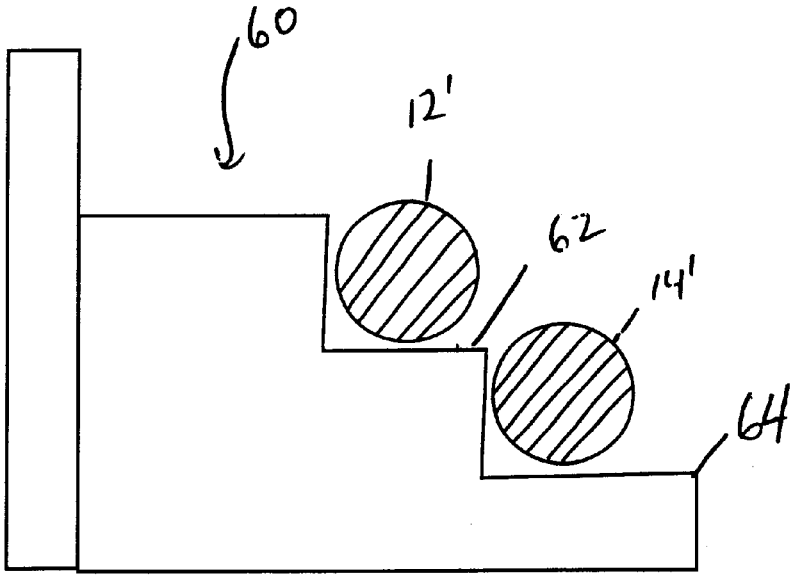
FIG. 7 is a side view of a back support block supporting both the first adjustable rack and the second adjustable rack.

In addition, as shown in FIG. 7, there is also a mid range support block 60 that is disposed within the catch basin 20. This support block 60 contains a series of steps 62 and 64 that are designed to support a series of spacer bars 12' and 14' in a substantially vertical manner. In that way, spacer bars 12' and 14' do not bend or bow in a middle region due to the weight of pots or plates placed upon racks 12 and 14.

Figure 8:
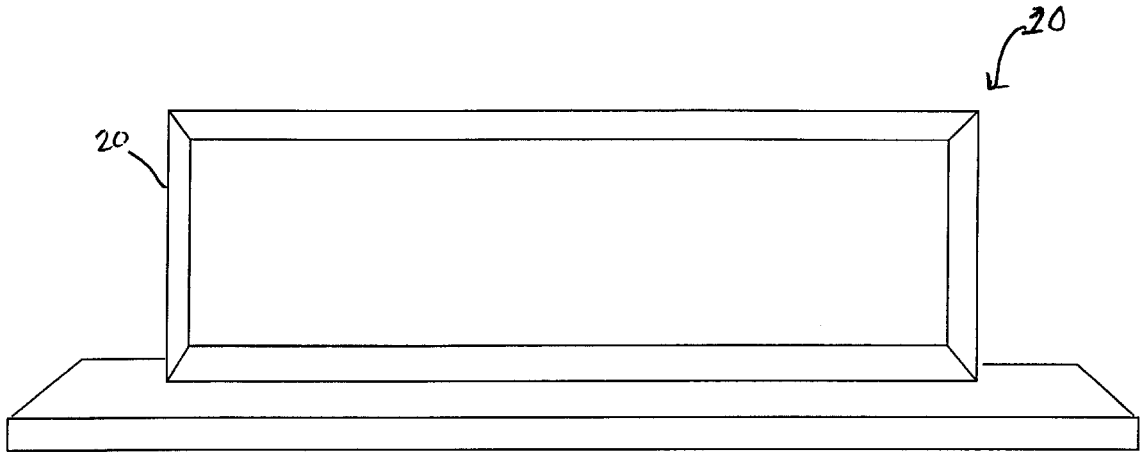
FIG. 8 is a side view of the invention in the folded up position.
Figure 9:
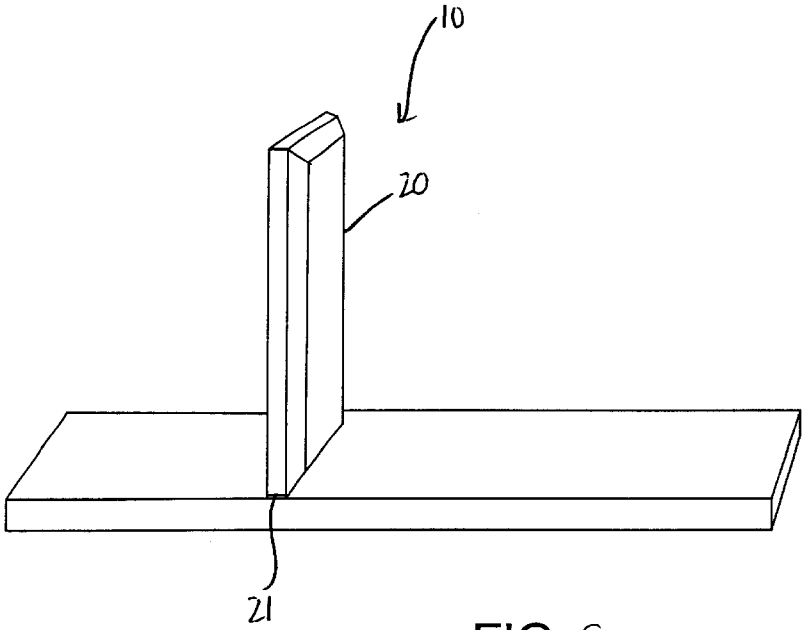
FIG. 9 is a perspective view of the invention in the folded up position.

As shown in FIGS. 8 and 9 the catch basin 20 can be folded up in a substantially vertical manner wherein the entire device can be positioned in an upright manner so that it can stand freely on a flat surface. The components of device 10 are positioned within catch basin 20 so that when racks 12, 14, and tray 30 are collapsed for storage it forms a balanced device that can be supported upright by wall 21 on catch basin 20.

Accordingly, while one embodiment of the present invention have been shown and described, it is to be understood that many changes and modifications may be made thereunto without departing from the spirit and scope of the invention as defined in the appended claims.

What is claimed is:

1. A device for supporting objects for drying comprising:

a) a catch basin;

b) a first adjustable rack having a front end and a back end wherein said back end attaches to said catch basin, and wherein when said first adjustable rack is in use, it extends in a substantially horizontal manner to support the objects above the catch basin;

c) a second adjustable rack rotatably attached to said catch basin, said second adjustable rack for supporting the objects wherein said first adjustable rack and said second adjustable rack each comprise a series of substantially parallel extending rods wherein said substantially parallel extending rods are spaced apart a sufficient distance to receive a plate therebetween;

d) an adjustable support bar rotatably attached to said first adjustable rack for rotatably adjusting a height of said front end of said first adjustable rack; and a catch block adapted to receive a front end of said second adjustable rack to lock said second adjustable rack on top of said first adjustable rack and into a collapsed position so that the device can be folded upright on a countertop.

2. The device as in claim 1, further comprising a plurality of support strips disposed within said catch basin wherein said support strips are designed to support said adjustable support bar in a position to keep said adjustable support bar from rotating when said adjustable support bar is supporting said substantially horizontal adjustable rack.

3. The device as in claim 1, wherein said second adjustable rack contains a plurality of extending bars that intersect with said first adjustable rack to stop any rotation of said second adjustable rack and to hold said second adjustable rack in place.

4. The device as in claim 1, wherein said catch basin contains a plurality of substantially vertical walls to enclose said catch basin.

5. The device as in claim 1, further comprising an adjustable tray being attached to said catch basin via at least one hinge so that said adjustable tray can either fold down into said catch basin or support a series of utensils in an upright position.

6. The device as in claim 5, wherein said adjustable tray comprises a set of adjustable legs attached to said catch basin, a top plate attached to said adjustable legs and at least one bottom container for receiving said series of utensils.

7. The device as in claim 6, wherein said adjustable tray further comprises a support arm having a first end rotatably attached to said catch basin and a second end designed to lock said adjustable tray in an upright position.

8. The device as in claim 6, wherein said adjustable tray comprises a tab attached to and extending below said top plate wherein said tab allows a user to grip said tray to either raise or lower said tray into an upright position to support said utensils or a folded down position for storage.

9. The device as in claim 1, wherein said first adjustable rack, said second adjustable rack, and said adjustable support bar are adjustable to collapse into said catch basin.

10. The device as in claim 1, further comprising a support block disposed in said catch basin and designed to support said first adjustable rack and said second adjustable rack.

11. The device as in claim 10, wherein said support block is fabricated in a step like configuration comprising a first step that supports said first adjustable rack and a second step that supports said second adjustable rack.

12. The device as in claim 1, wherein said catch basin contains at least one relief hole disposed within said catch basin to allow water to be drained out of said catch basin.

13. The device as in claim 1, further comprising a series of support ridges disposed in said catch basin wherein said support ridges support said adjustable support bar in a substantially horizontal manner so that said adjustable support bar forms an extended support platform extending out from said first adjustable rack.

14. A device for supporting objects for drying comprising:

a) a catch basin;

b) a first adjustable rack having a front end and a back end wherein said back end is attached to said catch basin and wherein when said first adjustable rack is in use, it extends in a substantially horizontal manner to support the objects;

c) a second adjustable rack rotatably attached to said catch basin, said second adjustable rack for supporting the objects;

d) an adjustable support bar rotatably attached to said first adjustable rack for rotatably adjusting a height of said front end of said first adjustable rack; and e) an adjustable tray disposed within said catch basin for supporting a plurality of utensils wherein said adjustable tray has a set of adjustable legs to allow said adjustable tray to fold down into said catch basin or to fold up to support the plurality of utensils.

* * * * *